US008435220B2

(12) United States Patent
Smith et al.

(10) Patent No.: US 8,435,220 B2
(45) Date of Patent: May 7, 2013

(54) EMERGENCY EYEWASH STATION HAVING AN EXPANDABLE BELLOWS WASTE COLLECTION SYSTEM

(75) Inventors: Daniel P. Smith, Portsmouth, RI (US); David J. Copeland, Milton, MA (US); Michael C. Pereira, Smithfield, RI (US)

(73) Assignee: Sperian Eye and Face Protection, Inc. a Delaware corporation, Smithfield, RI (US)

( * ) Notice: Subject to any disclaimer, the term of this patent is extended or adjusted under 35 U.S.C. 154(b) by 1154 days.

(21) Appl. No.: 11/551,963

(22) Filed: Oct. 23, 2006

(65) Prior Publication Data

US 2007/0089233 A1 Apr. 26, 2007

Related U.S. Application Data

(60) Provisional application No. 60/729,610, filed on Oct. 24, 2005.

(51) Int. Cl.
*A61H 33/04* (2006.01)

(52) U.S. Cl.
USPC ..... 604/302; 604/294; 604/291; 604/300; 604/297; 4/620

(58) Field of Classification Search ..... 604/294, 604/291, 300, 297; 4/620
See application file for complete search history.

(56) References Cited

U.S. PATENT DOCUMENTS

| | | | | |
|---|---|---|---|---|
| 348,361 | A * | 8/1886 | van Order | 417/473 |
| 1,638,159 | A | 8/1927 | Hopewell | |
| 2,545,947 | A * | 3/1951 | Felip et al. | 623/26 |
| 2,910,064 | A | 10/1959 | Brangaitis | |
| 2,999,248 | A | 9/1961 | Logan et al. | |
| 2,999,249 | A | 9/1961 | Logan et al. | |
| 3,035,737 | A | 5/1962 | Speas | |
| 3,106,722 | A | 10/1963 | Logan et al. | |
| 3,180,566 | A * | 4/1965 | Murat et al. | 417/473 |
| 3,871,554 | A | 3/1975 | Huck | |
| 3,904,083 | A | 9/1975 | Little | |

(Continued)

FOREIGN PATENT DOCUMENTS

| | | |
|---|---|---|
| CN | 1625382 | 6/2005 |
| EP | 0083782 | 7/1983 |

(Continued)

OTHER PUBLICATIONS

All Safety Products, Inc., "www.allsafetyprocuts.biz", Gravity FED Eye Wash Station.

(Continued)

*Primary Examiner* — Tatyana Zalukaeva
*Assistant Examiner* — Ilya Treyger
(74) *Attorney, Agent, or Firm* — Barlow, Josephs & Holmes, Ltd.

(57) ABSTRACT

An emergency eyewash station is disclosed. The emergency eyewash station includes a reservoir containing an eyewash fluid and a mechanism for dispensing the eyewash fluid from the reservoir to wash an injured person's eyes. An expandable container is configured and arranged to collect used eyewash fluid after the eyewash fluid has been dispensed to wash the injured person's eyes. The station can be further enhanced by equipping the expandable container with a pair of straps configured to compress the reservoir thereby providing a gravity assist to dispensing eyewash fluid.

7 Claims, 9 Drawing Sheets

U.S. PATENT DOCUMENTS

| | | | | |
|---|---|---|---|---|
| 4,012,798 | A | | 3/1977 | Liautaud |
| D250,594 | S | | 12/1978 | Gardner |
| 4,131,115 | A | | 12/1978 | Peng |
| 4,232,671 | A | | 11/1980 | Crump |
| 4,363,146 | A | | 12/1982 | Liautaud |
| 4,493,119 | A | | 1/1985 | Baumann |
| 4,527,716 | A | | 7/1985 | Haas et al. |
| 4,641,384 | A | | 2/1987 | Landsberger et al. |
| 4,675,924 | A | * | 6/1987 | Allison et al. ..... 4/620 |
| 4,688,276 | A | | 8/1987 | Allison et al. |
| 4,750,643 | A | | 6/1988 | Wortrich |
| 4,758,237 | A | | 7/1988 | Sacks |
| 4,784,652 | A | | 11/1988 | Wikstrom |
| 4,881,283 | A | | 11/1989 | Liautaud |
| 4,928,697 | A | | 5/1990 | Hsu |
| 4,938,421 | A | | 7/1990 | Berfield et al. |
| 4,939,800 | A | | 7/1990 | Fiorentino et al. |
| 4,998,850 | A | | 3/1991 | Crowell |
| 5,008,963 | A | | 4/1991 | Stein |
| 5,046,648 | A | | 9/1991 | Herbstzuber |
| 5,150,811 | A | | 9/1992 | Kelston |
| 5,157,798 | A | | 10/1992 | Van Kammen |
| 5,170,518 | A | | 12/1992 | Warriner |
| 5,171,306 | A | | 12/1992 | Vo |
| 5,195,655 | A | | 3/1993 | Bukhman |
| 5,201,726 | A | | 4/1993 | Kirkham |
| 5,216,765 | A | | 6/1993 | Paterson et al. |
| D342,309 | S | | 12/1993 | Paterson et al. |
| 5,320,615 | A | * | 6/1994 | Van Keuren ..... 604/297 |
| 5,334,180 | A | | 8/1994 | Adolf et al. |
| 5,381,567 | A | | 1/1995 | Tanner et al. |
| 5,401,259 | A | | 3/1995 | Py |
| 5,530,972 | A | | 7/1996 | Tanner |
| 5,531,707 | A | | 7/1996 | Kers |
| 5,566,406 | A | | 10/1996 | Demeny et al. |
| 5,607,410 | A | | 3/1997 | Branch |
| 5,634,458 | A | | 6/1997 | Joshi et al. |
| 5,695,124 | A | * | 12/1997 | Demeny et al. ..... 239/327 |
| 5,732,853 | A | | 3/1998 | Ganzeboom et al. |
| 5,740,569 | A | | 4/1998 | Gurries, II et al. |
| 5,754,900 | A | | 5/1998 | Suda |
| 5,791,519 | A | | 8/1998 | Van Marcke |
| 5,850,641 | A | | 12/1998 | Demeny et al. |
| 5,967,197 | A | | 10/1999 | Shown |
| 6,029,293 | A | | 2/2000 | Paterson et al. |
| 6,070,279 | A | * | 6/2000 | Lundstedt ..... 4/620 |
| 6,098,844 | A | | 8/2000 | Nicolle |
| 6,131,766 | A | | 10/2000 | King et al. |
| 6,142,344 | A | | 11/2000 | Kai |
| 6,161,228 | A | | 12/2000 | Wietecha |
| 6,186,361 | B1 | | 2/2001 | Teetsel, III |
| D438,983 | S | | 3/2001 | Stein |
| 6,205,599 | B1 | | 3/2001 | Anders |
| 6,270,014 | B1 | | 8/2001 | Bollas et al. |
| 6,296,626 | B1 | | 10/2001 | Stein |
| 6,385,794 | B1 | | 5/2002 | Miedzius et al. |
| 6,398,766 | B1 | | 6/2002 | Branch |
| 6,432,078 | B1 | | 8/2002 | Peyman |
| 6,458,108 | B1 | | 10/2002 | Tangri |
| D466,589 | S | | 12/2002 | Miedzius |
| 6,510,965 | B1 | | 1/2003 | Decottignies et al. |
| 6,520,431 | B2 | | 2/2003 | Donovan |
| 6,540,726 | B1 | | 4/2003 | Follman et al. |
| 6,554,164 | B1 | | 4/2003 | Jones |
| 6,561,383 | B1 | | 5/2003 | Reddy et al. |
| 6,595,920 | B2 | | 7/2003 | Walton |
| 6,610,036 | B2 | | 8/2003 | Branch et al. |
| 6,726,061 | B2 | | 4/2004 | Good |
| 6,758,837 | B2 | | 7/2004 | Peclat et al. |
| 6,782,568 | B2 | | 8/2004 | Novak et al. |
| 6,913,598 | B2 | | 7/2005 | Tangri |
| 2001/0052681 | A1 | | 12/2001 | Deavila |
| 2003/0032930 | A1 | | 2/2003 | Branch |
| 2003/0208186 | A1 | | 11/2003 | Moreyra |
| 2004/0039354 | A1 | * | 2/2004 | Lutz, II ..... 604/291 |
| 2004/0124211 | A1 | | 7/2004 | Jones |
| 2004/0204674 | A1 | | 10/2004 | Anderson et al. |
| 2004/0244106 | A1 | | 12/2004 | Chesters |
| 2005/0054992 | A1 | | 3/2005 | Madritsch et al. |
| 2005/0077318 | A1 | | 4/2005 | Macler et al. |
| 2005/0217019 | A1 | | 10/2005 | Johnson et al. |

FOREIGN PATENT DOCUMENTS

| | | | |
|---|---|---|---|
| EP | 0723769 | B1 | 7/2001 |
| FR | 2625098 | | 6/1989 |
| GB | 1460064 | | 12/1976 |
| GB | 2157569 | A | 10/1985 |
| JP | 10151148 | | 6/1998 |
| JP | 2001-079061 | | 3/2001 |
| WO | WO8702237 | | 4/1987 |
| WO | 8705498 | | 9/1987 |
| WO | WO9619177 | A1 | 6/1996 |
| WO | WO03065967 | A1 | 8/2003 |

OTHER PUBLICATIONS

PlumberSurplus, "www.plumbersurplus.com", Speakman SE-577-SD Emergency Safety Equipment Eyewash Station.

Ramsey Group, "www.ramsey-group.com/pureflow1000.html", Fend-All Pure Flow 1000 Emergency Eyewash Station (FEN-1000).

First Aid Supplies & Safety Products, "www.firstaidandsafetyonline.com/showproduct-catid-24.asp", Eyewash Station; Bradley Eyewash Stations, Emergency Eyewash Station, Portable Eyewash.

* cited by examiner

EMERGENCY EYEWASH STATION HAVING AN EXPANDABLE BELLOWS WASTE COLLECTION SYSTEM

CROSS-REFERENCE TO RELATED APPLICATION

The present invention claims priority to earlier filed U.S. Provisional Patent Application 60/729,610, filed Oct. 24, 2005, the contents of which are incorporated herein by reference.

BACKGROUND OF THE INVENTION

1. Field of the Invention

The present invention relates generally to emergency eyewash stations and more particularly to such a station having an expandable bellows waste collection system.

2. Background of the Related Art

Government and employers are increasingly aware of the need for protecting the health and safety of workers. For this reason, it is common to find eye wash fountains at industrial work sites, laboratories, and other locations where workers are exposed to gaseous fumes, liquids or solid materials which can irritate or injure eyes upon contact therewith. The Occupational Safety and Health Administration (OSHA) has made eye wash fountains mandatory for particular industrial work sites.

Early installations of eye wash fountains employed sprays of regular tap water fed from regular plant plumbing connections. These devices were adequate for a period of time, but suffered from the drawbacks of using the regular water supply. For example, there could be contaminants and bacteria in regular plumbed water. Furthermore, the pressure of regular running water is inconsistent creating an uneven water flow, or in the event of a major facility accident, the water may not be running at all.

Later devices, such as the eye wash fountains disclosed in U.S. Pat. No. 4,012,798 to Liautaud and U.S. Pat. No. 4,363,146 to Liautaud, were self-contained, gravity-fed, and independent of any plumbing connections. These self-contained eye wash fountains typically included a reservoir (or bottle)s of wash fluid spaced above two opposed liquid spray nozzles. Upon activating the fluid flow, the wash fluid from the reservoir is fed solely by gravity to the nozzles to cause a gravity-induced spray of wash fluid from the nozzles. These stations provided improved safety in terms of the quality of the water utilized but suffered from low and/or inconsistent water pressure to properly flush the eyes.

In an effort to encourage more suitable eye wash facilities, the American National Standards Institute (ANSI) promulgated voluntary standards for portable eye wash fountains relating to flushing periods and the rate of flow of wash fluid. These standards dictate that portable eye wash fountains should deliver no less than 0.4 gallons per minute (1.5 liters per minute) of eye wash fluid for a time period of 15 minutes. Responsive to the new ANSI standard, several designs emerged that included means for maintaining a constant eyewash flow rate without any powered pumping mechanisms. For example, U.S. Pat. Nos. 5,566,406, 5,695,124 and 5,850,641 all issued to Demeny et al, disclose an emergency eyewash station having a gravity assist mechanism that acts on a flexible bag contained in a disposable paperboard box. The self-contained emergency eye wash station generally comprises a housing, a collection reservoir, and a platen. The housing includes a shelf that supports a pair of flexible containers arranged in side-by-side relation. The flexible containers are of the type generally referred to as "bag-in-a-box" packaging, having an inner flexible plastic bag containing the eyewash fluid, and an outer cardboard box structure, which supports the flexible bag in a predetermined shape. The housing further supports a delivery platform including a nozzle, which is in fluid communication with the flexible container. The nozzle selectively dispenses the eye wash fluid from the flexible container when activated. The delivery platform further includes a drain that captures the eye wash fluid dispensed from the nozzle and directs the eye wash fluid into the reservoir. The reservoir is slidably mounted to the housing while the platen is connected to the reservoir. As the reservoir fills, the platen presses downward on the flexible container with a downward gravitational force proportional to a weight of the eye wash fluid collected in the reservoir. The transfer of the weight of the eye wash fluid collected in the reservoir to the platen maintains a constant flow of eye wash fluid dispensed from the nozzle.

The above-noted gravity assist configuration has been very successful in the marketplace and is still in widespread use today. However, there is always a need for continuous improvement in safety products. One area in which the industry has asked for improvement is in making the overall size of eye-wash stations smaller. Smaller sizes translate into lower shipping costs and lower storage space requirements, along with making it easier to locate the eye-wash stations in smaller work areas. It is noted that many new eye-wash stations are being installed in locations which did not originally accommodate such safety equipment, and smaller stations make it easier to locate the units in these locations. One particular part of the station which has been ignored is the collection reservoir which is a large "empty" container attached to the bottom of the station. Improvement in the location, and or functional operation of the reservoir is needed.

Accordingly, there is a need in the industry for an improved emergency eye-wash station assembly which is smaller in size, yet still provides for all of the same functionality of the earlier prior art systems. In particular, there is a need for a reservoir collection system for an emergency eyewash station that is unobtrusive and aesthetically pleasing, yet operates effectively to ensure little or no spillage of eyewash fluid.

SUMMARY OF THE INVENTION

The present invention seeks to solve the shortcomings of the prior art devices by providing an emergency eyewash station that includes an expandable bellows as the waste collection system.

The emergency eyewash station of the present invention includes main body portion that houses an inner cartridge assembly containing eyewash fluid. The main body portion further includes a pivoting actuator arm assembly with a dispensing structure thereon. Finally, the station includes an expandable bellows collection reservoir attached below the main body portion.

The unit functionally dispenses the eyewash fluid similar to the prior art device as described in U.S. Pat. No. 5,566,406. The dispensing structure is connected to the eyewash fluid cartridge. Activation of the actuator arm assembly dispenses the eyewash fluid contained in the cartridge. The dispensed fluid is collected by a drain system and directed into the expandable reservoir.

The expandable bellows reservoir comprises a flexible rubber bellows-like structure having an open upper end connected to the drain and a closed bottom end. The expandable reservoir is expandable from an initial compressed state having a very small interior volume to an expanded state having an interior volume in excess of the required flush volume of approximately 6 gallons. The expandable reservoir is initially compressed to a flattened state so as to be substantially hidden from view when the unit is not in use. However, when the station is activated, and the waste fluid begin to accumulate and drain into the reservoir, the bellows can expand downwardly to increase the interior volume and capture the full volume of the eyewash fluid dispensed despite having a much smaller interior volume in its initial compressed state.

As part of an improved eyewash station that functions with a gravity assist as described in the prior art, the expandable collection system can include a gravity feed-assist mechanism, including a pair of strap extending underneath the reservoir so as to pull downwardly on the inner bladder to control the flow of eyewash fluid therefrom.

BRIEF DESCRIPTION OF THE DRAWINGS

These and other features, aspects, and advantages of the present invention will become better understood with reference to the following description, appended claims, and accompanying drawings where:

DESCRIPTION OF THE PREFERRED EMBODIMENT

Figure 1:
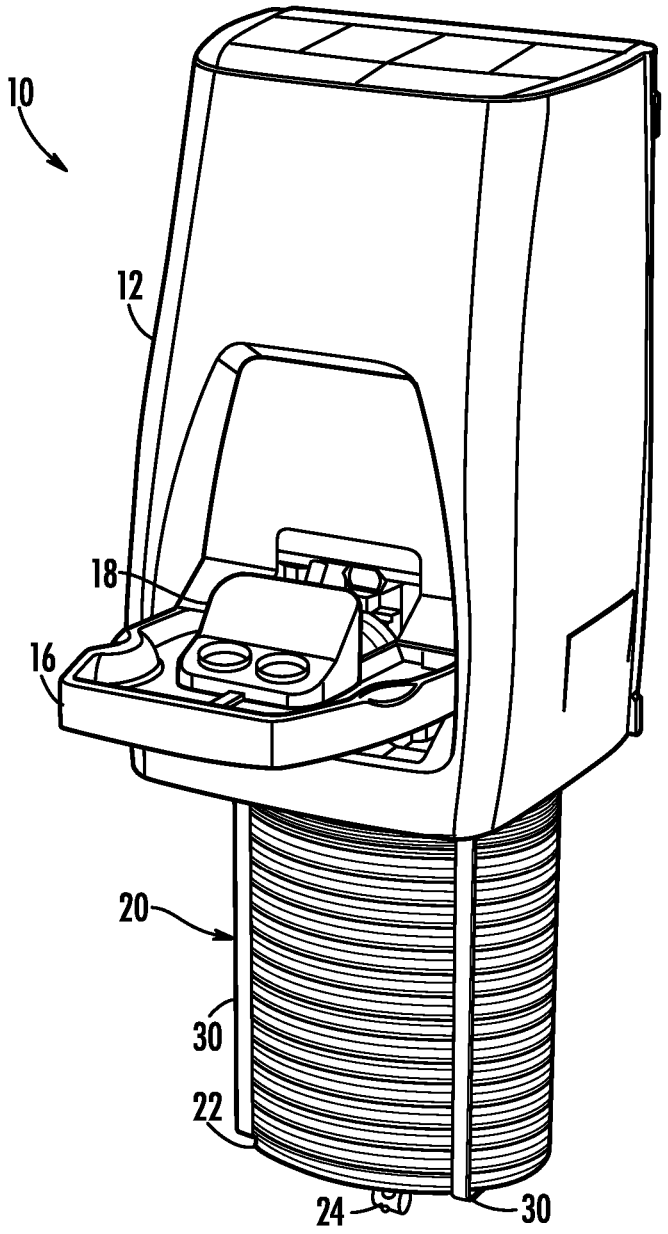
FIG. 1 is a perspective view of the preferred embodiment of the present invention.

Referring the FIG. 1, the emergency eyewash station of the present invention is shown generally at 10. As will be described in greater detail below, the emergency eyewash station 10 of the present invention includes main body portion 12 that houses a cartridge assembly having an inner bladder 14 (best seen in FIG. 7) containing eyewash fluid. The main body portion 12 includes a pivoting actuator arm assembly 16 with dispensing structure 18 thereon. The expandable bellows 20 waste collection system is attached below the main body portion 12.

The dispensing structure 18 is connected to the inner bladder 14, such that activation of the actuator arm assembly 16 causes the eyewash fluid contained in the inner bladder 14 to be dispensed from the dispensing structure 18.

Figure 4:
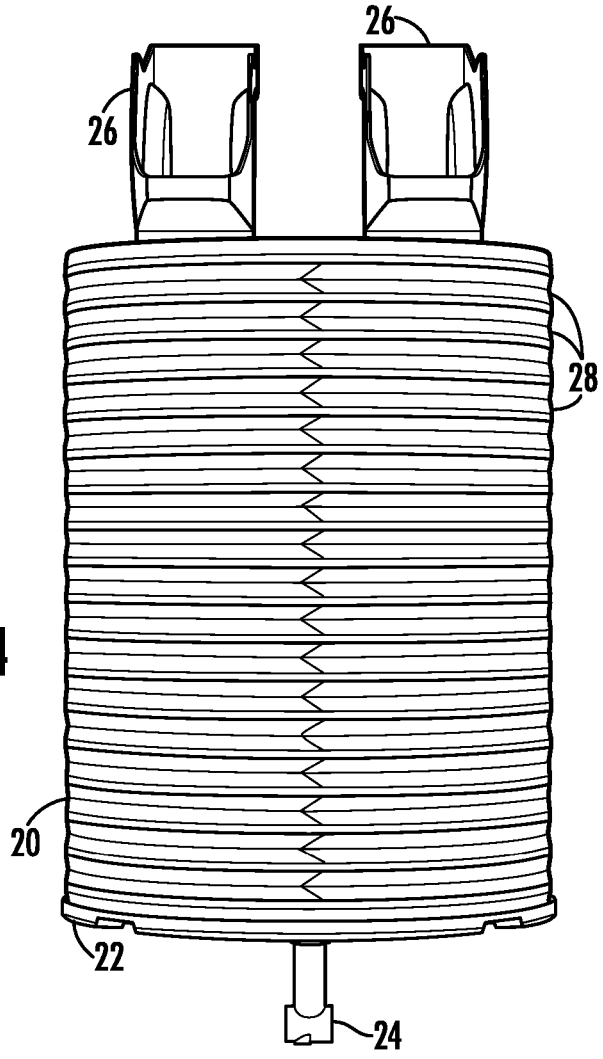
FIG. 4 is a front elevation view of the expanded bellows of the preferred embodiment of the present invention.
Figure 5:
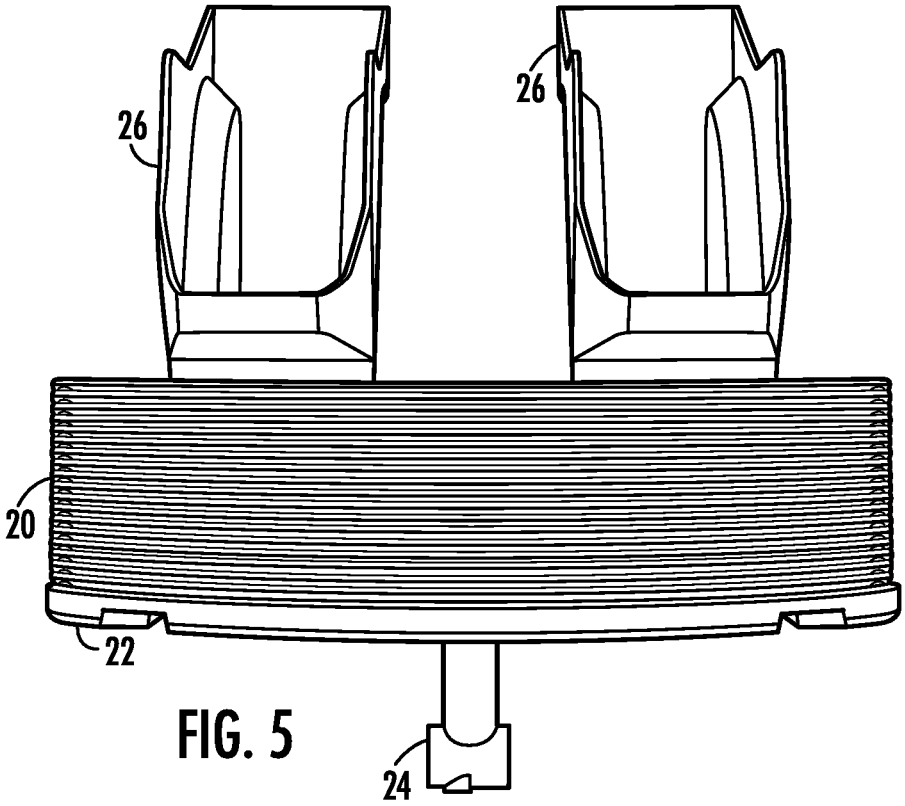
FIG. 5 is a front elevation view of the compressed bellows of the preferred embodiment of the present invention.

Referring to FIGS. 4 and 5, the expandable bellows 20 can be made out of any material capable of holding a liquid, and is most preferably made of an elastomeric material that retains a natural resiliency that tends to want to expand to its deployed length, the advantages of which will be described in greater detail below. The expandable bellows 20 has a series of pleated folds 28 forming an accordion folding receptacle, thus allowing it to be expandable from a compressed state having a relatively small interior volume, as shown in FIG. 5, to an expanded state having a volume in excess of the 6 gallons of eyewash fluid stored in the cartridge assembly, as shown in FIG. 4.

Referring to FIG. 4, the expandable bellows 20 of the present invention is shown isolated from the eyewash station assembly 10. In addition to the expandable bellows 20, the waste collection system also includes an optional bottom platen 22 to support the bellows, a drain plug 24 and a top reservoir assembly 26. The top reservoir 26 assembly includes two reservoirs that act as funnels into the expandable bellows for the eyewash fluid draining from the dispensing structure.

Figure 2:
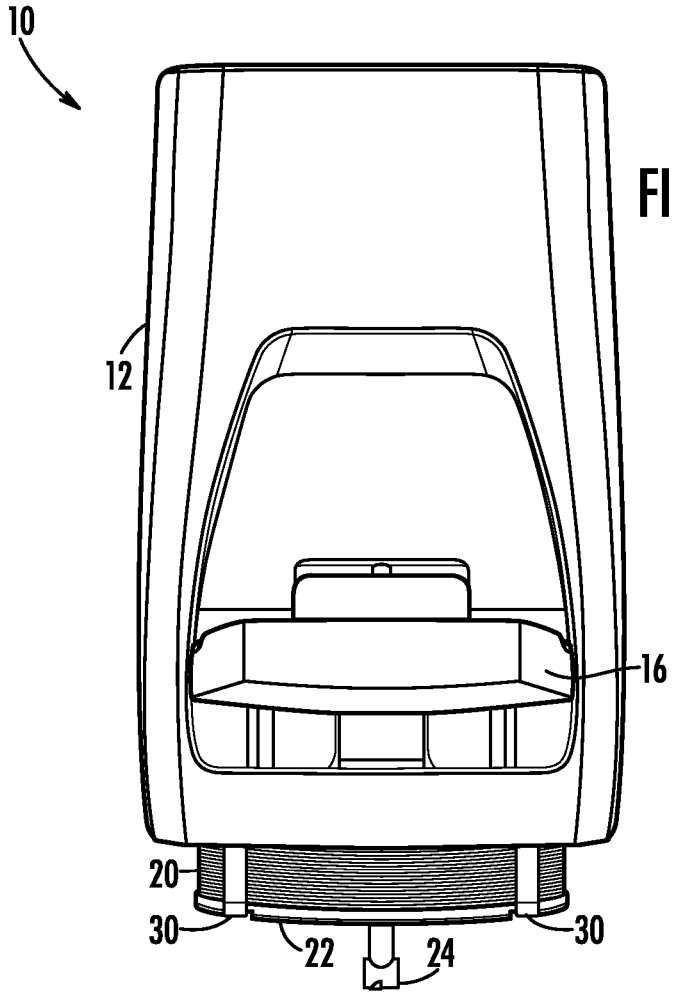
FIG. 2 is a front elevation view of the preferred embodiment of the present invention with the bellows compressed.
Figure 3:
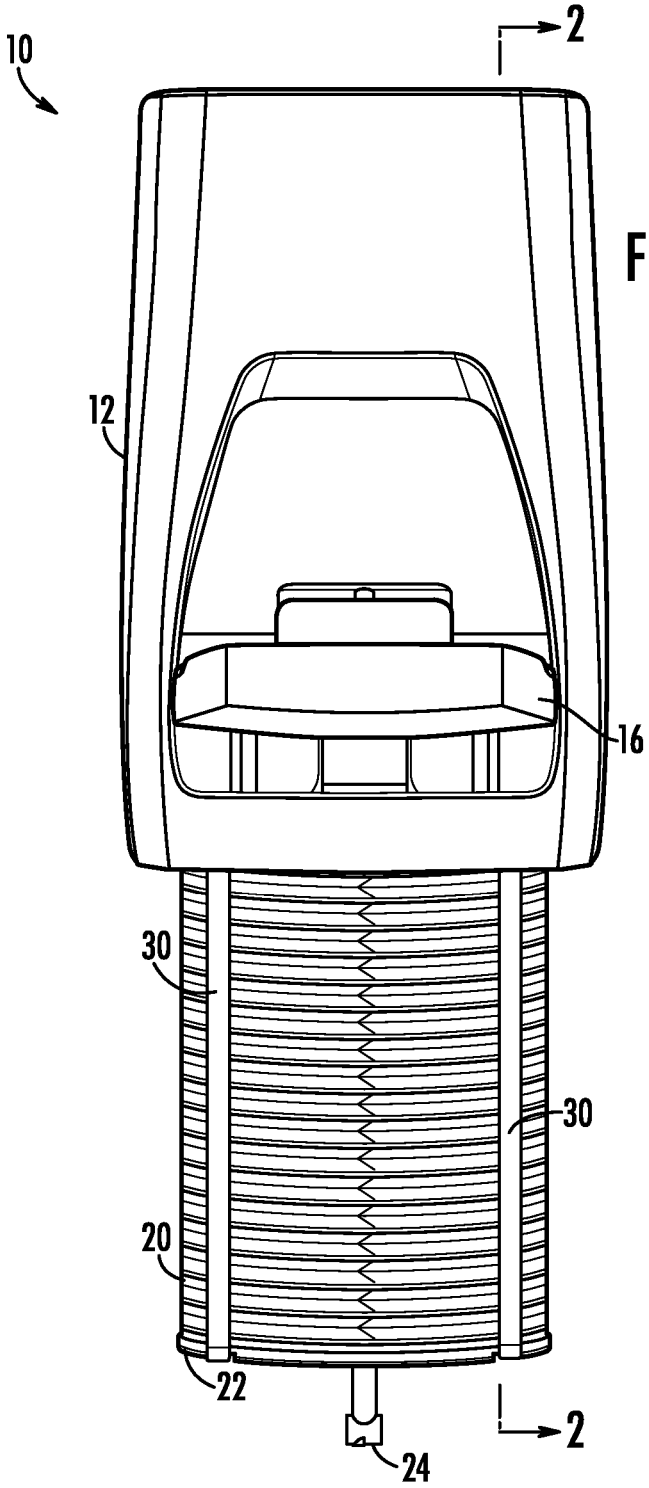
FIG. 3 is a front elevation view of the preferred embodiment of the present invention with the bellows deployed.
Figure 7:
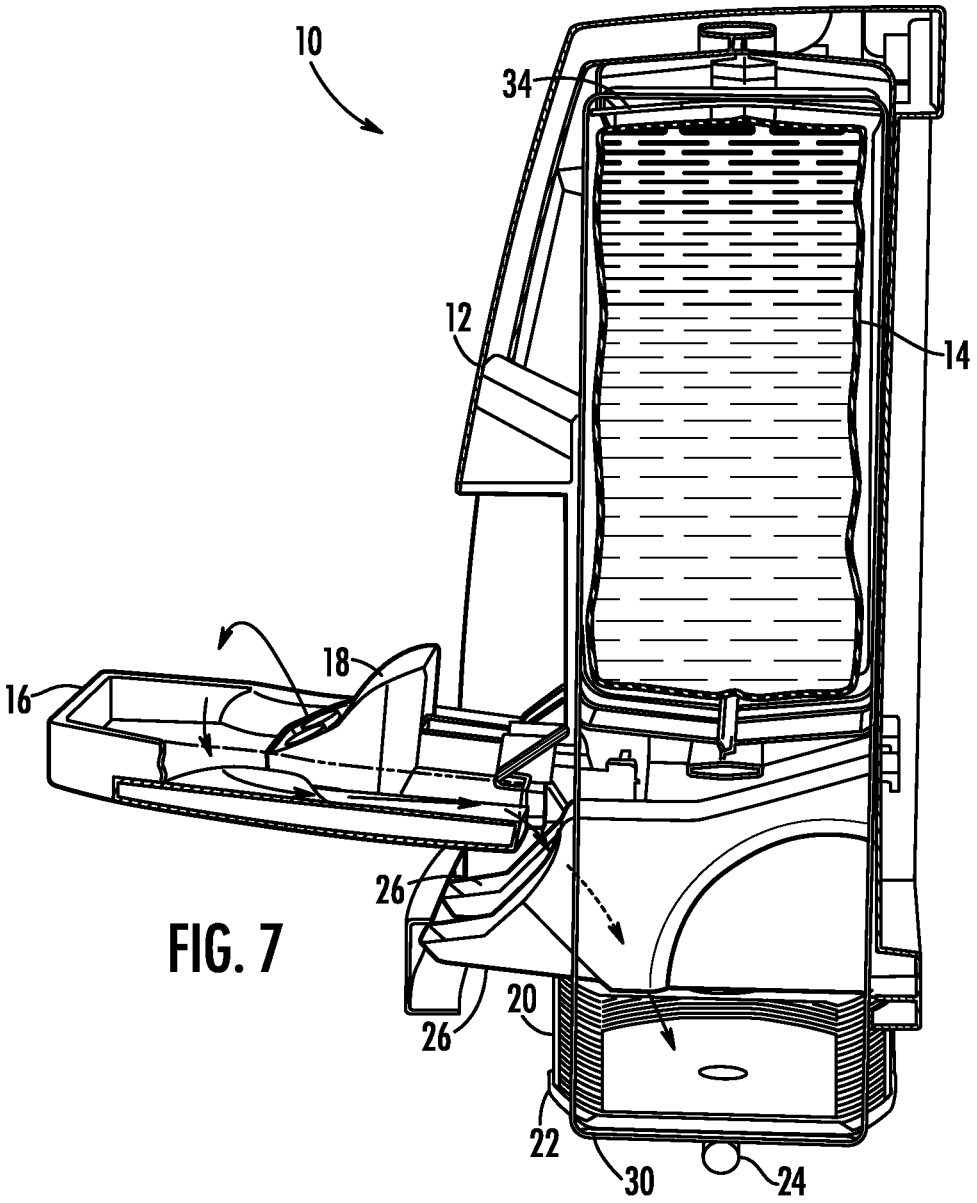
FIG. 7 is a partial side cross-section view through line 2-2 of FIG. 2.

Referring to FIGS. 2, 5 and 7, the expandable bellows 20 is shown in a compressed state, prior to activation of the eyewash station 10. After activation of the eyewash station 10, the bellows 20 expands as the eyewash collects into it, as shown in FIGS. 1, 3, 4 and 8.

Figure 6:
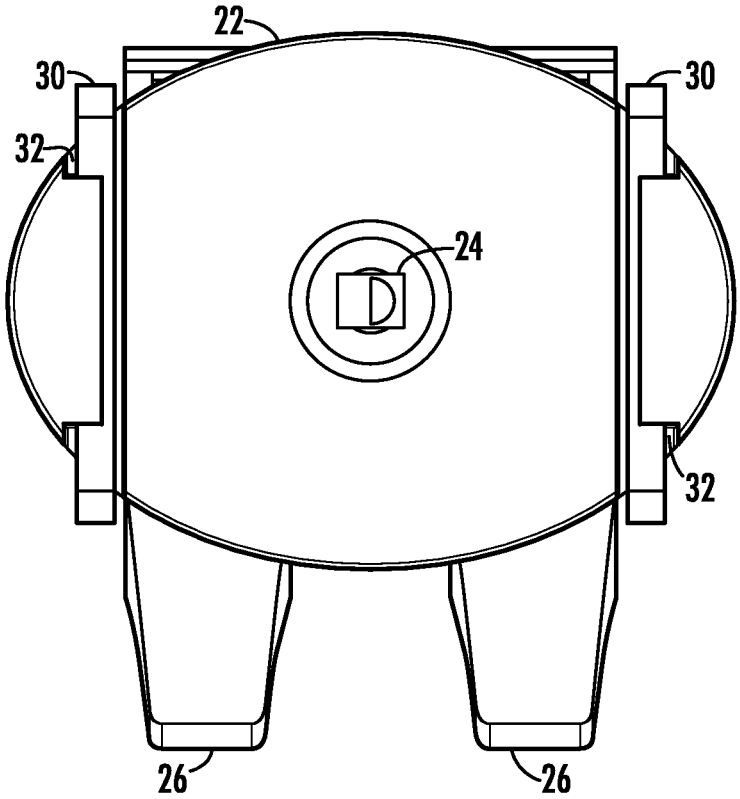
FIG. 6 is a bottom view of the bellows of the preferred embodiment of the present invention.
Figure 8:
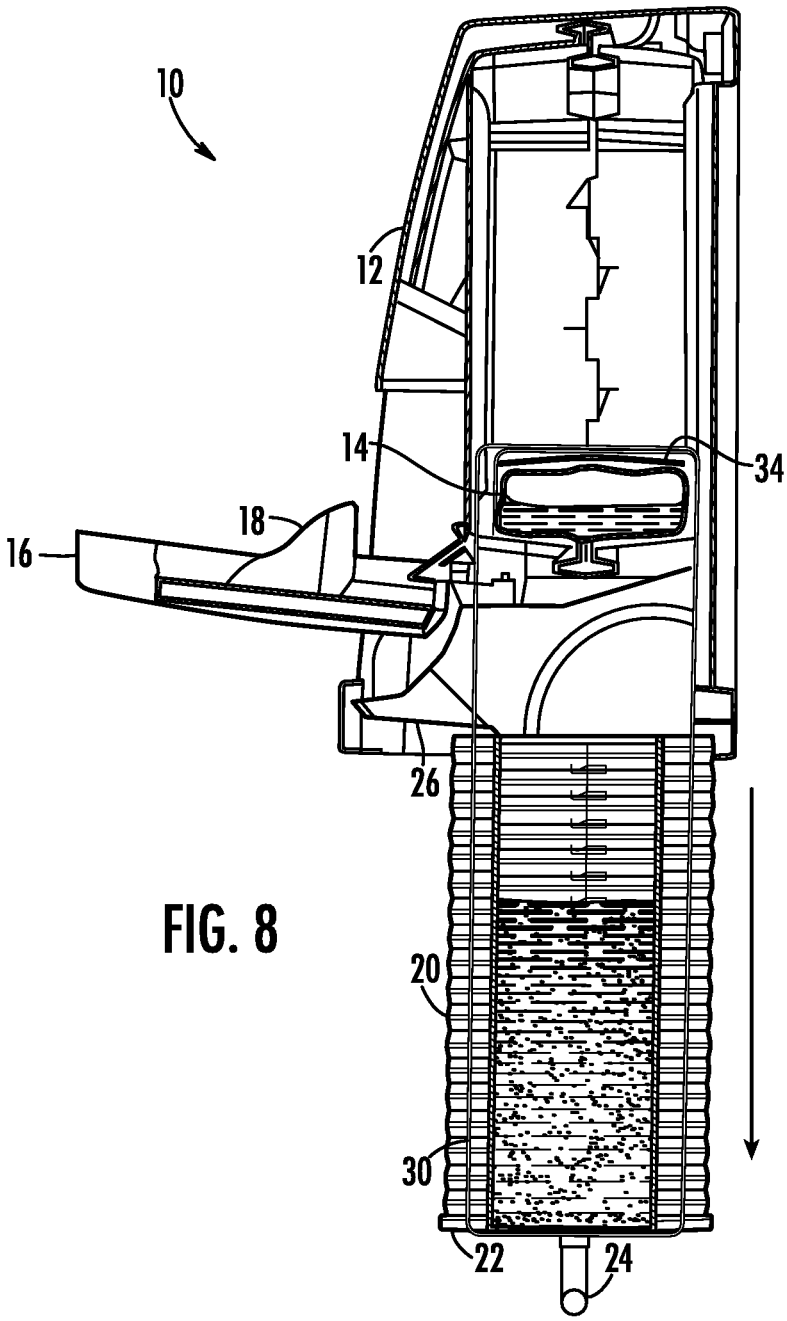
FIG. 8 is a partial side cross-section view through line 3-3 of FIG. 3.

The gravity assist mechanism comprises a pair of straps 30 secured around the expandable bellows 20 and received into slots on the bottom platen 32 as shown in FIG. 6. The straps 30 serve to keep the expandable bellows 20 compressed prior to activation of the emergency eyewash station 10 and then, after activation, serve to help the gravity feed of the eyewash fluid. The straps 30 extend upwardly and over a top platen 34 which rests atop the inner bladder 14 as shown in FIG. 7. As best seen in FIGS. 7 and 8, after activation of the emergency eyewash station 10, the eyewash fluid immediately starts to spray out of the dispensing structure 18, drain down into the actuator arm assembly 16, then into the top reservoir assembly 26 and finally into the expandable bellows 20. The natural resiliency of the bellows 20 trying to naturally expand tends to pull downwardly on the straps 30 and thus on the top platen 34 which compresses the inner bladder 14 resulting in a continuous evacuation of the eyewash fluid contained therein. As the expandable bellows 20 expands, however, the outward expansion force of the bellows 20 decreases. The weight of the bellows 20 and the eyewash fluid contained therein serves to compensate for the decrease in spring-force of the expandable bellows 20 as the heavier eyewash fluid and bellows combination pulls downwardly on the straps 30 through the force of gravity.

Figure 9:
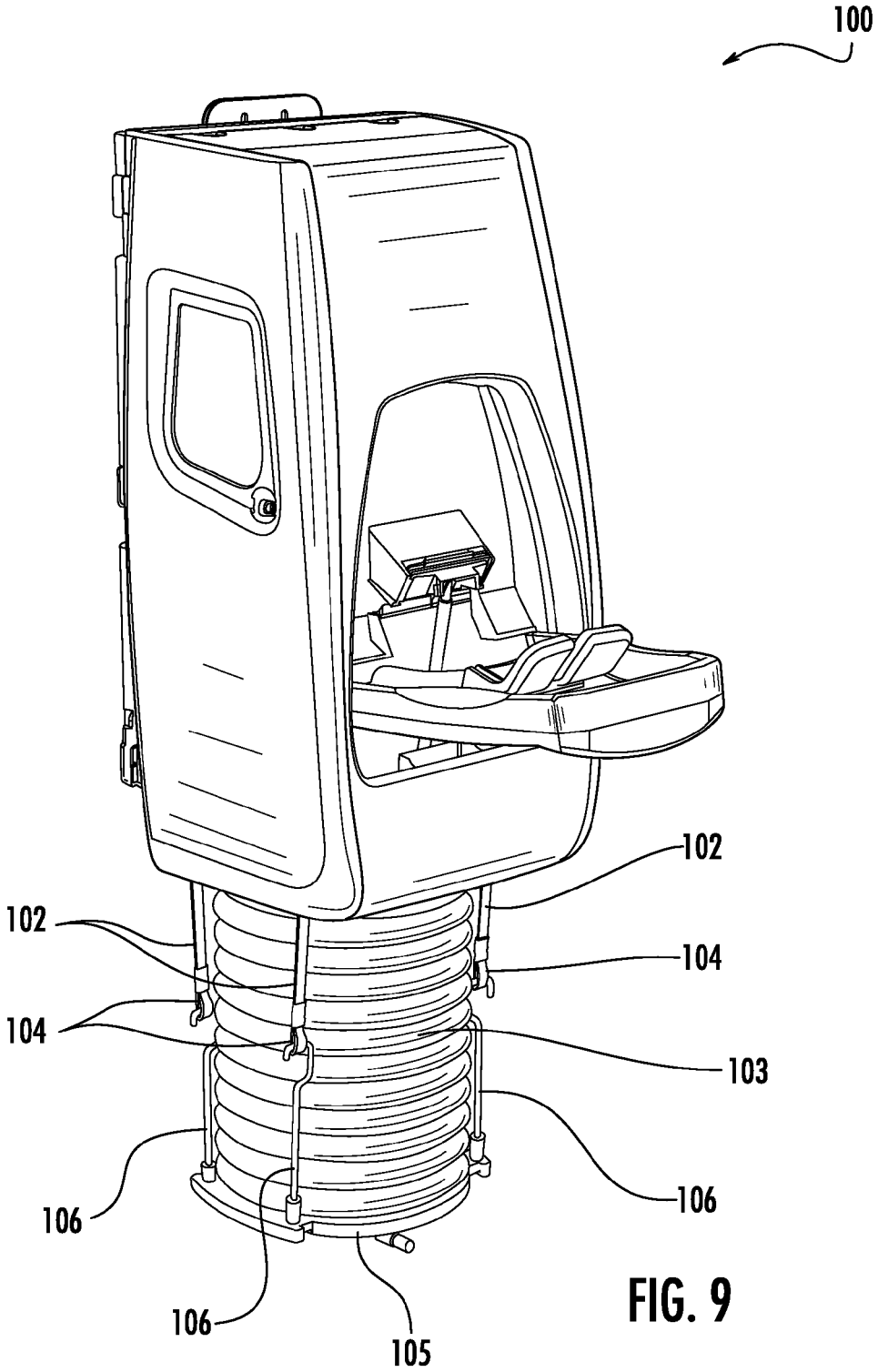
FIG. 9 is a perspective view of an alternative embodiment.

Turning now to FIG. 9, an alternative embodiment of the eyewash station of the present invention is shown generally at 100. The alternative embodiment is very similar to the preferred embodiment 10 with the following exceptions. Four straps 102, similar in function and operation to the straps 30 in the preferred embodiment 10, are secured around the expandable bellows 103 and are hooked onto the bottom platen 105 via four stabilizers 106 having hooked ends. The straps 102 have looped ends 104 in order to hook them onto the stabilizers 106. It has been found that the stabilizers 106 help keep the bellows 103 descending straight down and prevent the bellows 103 from cantering to one side or another as the bellows 103 fills with dispensed eyewash fluid.

Therefore, it can be seen that the present invention provides a unique solution to the problems of the prior art by providing an emergency eyewash station that includes a novel expandable bellows waste collection system that also assists the gravity feed of the eyewash station.

It would be appreciated by those skilled in the art that various changes and modifications can be made to the illustrated embodiments without departing from the spirit of the present invention. All such modifications and changes are intended to be within the scope of the present invention except as limited by the appended claims.

What is claimed is:

1. An emergency eyewash station, comprising:

a reservoir, said reservoir containing an eyewash fluid;

an expandable container configured and arranged to collect the dispensed eyewash fluid;

a dispensing mechanism configured and arranged to dispense eyewash fluid from said reservoir to wash an injured person's eyes; and at least one strap, said at least strap configured to apply pressure to said reservoir as said eyewash fluid collects in said expandable container.

2. The eyewash station of claim 1, wherein said bellows pulls on said at least one strap as said bellows is expanding thereby applying pressure to said flexible reservoir.

3. An emergency eyewash system, comprising:

a body portion, a flexible reservoir located within said body portion, said reservoir containing an eyewash fluid;

means for dispensing said eyewash fluid from said reservoir to wash an injured person's eyes;

an expandable bellows container configured and arranged to collect the dispensed eyewash fluid; and means coupled to said flexible reservoir, for applying pressure to said flexible reservoir to cause the eyewash fluid to be dispensed.

4. The eyewash station of claim 3, wherein said bellows is resilient and tends to want to expand and become uncompressed.

5. The eyewash station of claim 3, wherein said means for applying pressure to said reservoir includes:

at least one strap, said at least strap configured to apply pressure to said reservoir as said eyewash fluid collects in said expandable container.

6. The eyewash station of claim 5, wherein said bellows pulls on said at least one strap as said bellows is expanding thereby applying pressure to said flexible reservoir.

7. The eyewash station of claim 3, further comprising:

a drain plug located on said expandable bellows container.

* * * * *